US007314269B2

(12) United States Patent
Kusunoki

(10) Patent No.: US 7,314,269 B2
(45) Date of Patent: Jan. 1, 2008

(54) IMAGE FORMING APPARATUS AND METHOD

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/645,667

(22) Filed: Dec. 27, 2006

(65) Prior Publication Data

US 2007/0146433 A1 Jun. 28, 2007

(30) Foreign Application Priority Data

Dec. 28, 2005 (JP) ..... 2005-378973

(51) Int. Cl.
*B41J 2/05* (2006.01)

(52) U.S. Cl. ..... 347/57; 347/19; 347/68

(58) Field of Classification Search ..... 347/19, 347/56, 57, 68, 10, 11
See application file for complete search history.

(56) References Cited

U.S. PATENT DOCUMENTS

| | | | | |
|---|---|---|---|---|
| 6,527,354 | B2 * | 3/2003 | Takahashi | 347/9 |
| 6,890,060 | B2 * | 5/2005 | Yakura et al. | 347/41 |
| 7,240,998 | B2 * | 7/2007 | Murakami et al. | 347/78 |
| 2003/0103093 | A1 * | 6/2003 | Vanhooydonck | 346/43 |

FOREIGN PATENT DOCUMENTS

| | | |
|---|---|---|
| JP | 8-104004 A | 4/1996 |

OTHER PUBLICATIONS

Fukumoto et al., Journal of Imaging Science and Technology, vol. 44, No. 5, Sep./Oct. 2000, pp. 398-405.

* cited by examiner

*Primary Examiner*—Lamson Nguyen
(74) *Attorney, Agent, or Firm*—Birch, Stewart, Kolasch & Birch, LLP

(57) ABSTRACT

The image forming apparatus includes: a liquid chamber into which ink is filled; an ejection port through which the ink is ejected from the liquid chamber; a mist generation device which generates a mist from a surface of the ink inside the ejection port by applying vibration energy to the ink in the liquid chamber; an electric field generation device which generates an electric field causing the mist ejected from the ejection port to move to a recording medium; and a setting device which sets at least one of drive conditions of the mist generation device and a recording resolution in such a manner that a relationship Pt≧d2 is satisfied, where d2 is an overlap-permissible diameter which is a minimum distance between centers of two mist dots formed by the mist on the recording medium that allows shapes of the two mist dots to be fixed as a prescribed shape when the two mist dots are deposited on the recording medium substantially simultaneously under substantially same ejection conditions so as to overlap partially with each other, and Pt is a pitch between the centers of the two mist dots defined by the recording resolution.

5 Claims, 14 Drawing Sheets

FIG.7A
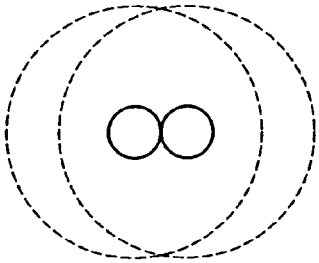
FIG.7B
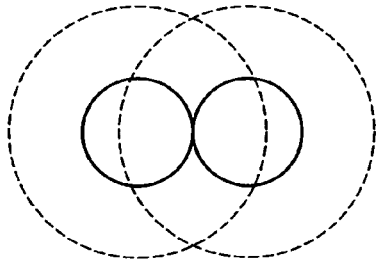
FIG.7C
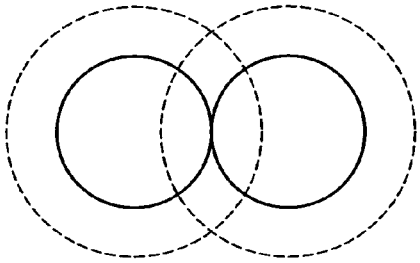
FIG.7D
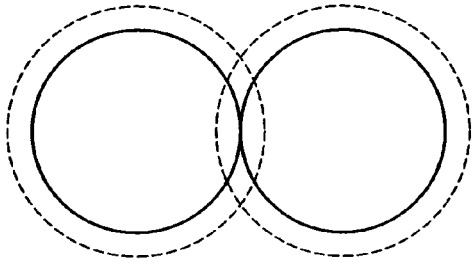
FIG.8
RESULTS OF EVALUATION OF DOT SHAPE PRESERVATION
(HIGH-DENSITY DOTS)
| VIRTUAL DIAMETER RATIO d3/d1 | IMAGE QUALITY EVALUATION RESULT (DOT SHAPE PRESERVATION) | REMARKS |
|---|---|---|
| 0.2 | POOR | FIG. 7A |
| 0.4 | POOR | FIG. 7B |
| 0.6 | GOOD | FIG. 7C |
| 0.8 | GOOD | FIG. 7D |

FIG.10
RESULTS OF EVALUATION OF DOT SHAPE PRESERVATION
(MEDIUM-DENSITY DOTS)
| VIRTUAL DIAMETER RATIO d3/d1 | IMAGE QUALITY EVALUATION RESULT (DOT SHAPE PRESERVATION) | REMARKS |
|---|---|---|
| 0.2 | POOR | FIG. 7A |
| 0.4 | GOOD | FIG. 7B |
| 0.6 | GOOD | FIG. 7C |
| 0.8 | GOOD | FIG. 7D |
FIG.11A
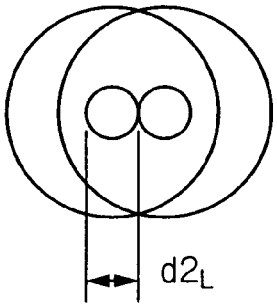
FIG.11B
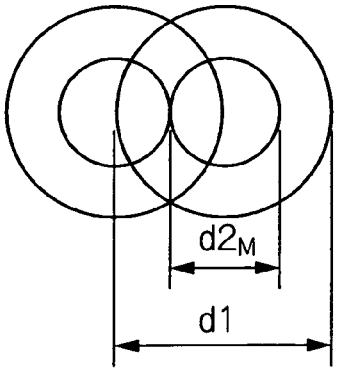
FIG.11C
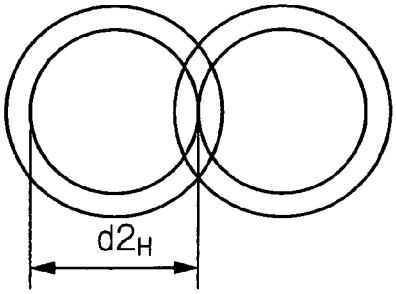

IMAGE FORMING APPARATUS AND METHOD

BACKGROUND OF THE INVENTION

1. Field of the Invention

The present invention relates to an image forming apparatus and method, and more particularly to an image forming apparatus and method in which a group of ink microparticles (ink mist) is generated by ultrasonic waves so as to record images by means of the ink mist.

2. Description of the Related Art

Japanese Patent Application Publication No. 8-104004 discloses an ink mist type of image recording apparatus (ink mist printer) which records images by generating a flow of ink mist (very fine ink particles) by means of ultrasonic vibration, and depositing this ink mist onto a recording medium as a group (cluster).

In Japanese Patent Application Publication No. 8-104004, in order to create ink mist efficiently, a piezoelectric substrate serving as a vibration source has a concave on the side facing the ink ejection port, at least at an electrode installation region. However, if the mist is ejected to form dots on a recording medium in an overlapping fashion at high speed by using the mist spraying type of recording head, then deposition interference occurs between the formed dots, the dot shapes are disrupted and color mixing may arise between the dots, and therefore a high-quality image cannot be obtained.

SUMMARY OF THE INVENTION

The present invention has been contrived in view of such circumstances, an object thereof being to provide an image forming apparatus and method capable of achieving high-quality printing at high speed.

In order to attain the aforementioned object, the present invention is directed to an image forming apparatus, comprising: a liquid chamber into which ink is filled; an ejection port through which the ink is ejected from the liquid chamber; a mist generation device which generates a mist from a surface of the ink inside the ejection port by applying vibration energy to the ink in the liquid chamber; an electric field generation device which generates an electric field causing the mist ejected from the ejection port to move to a recording medium; and a setting device which sets at least one of drive conditions of the mist generation device and a recording resolution in such a manner that a relationship $Pt \geqq d2$ is satisfied, where d2 is an overlap-permissible diameter which is a minimum distance between centers of two mist dots formed by the mist on the recording medium that allows shapes of the two mist dots to be fixed as a prescribed shape when the two mist dots are deposited on the recording medium substantially simultaneously under substantially same ejection conditions so as to overlap partially with each other, and Pt is a pitch between the centers of the two mist dots defined by the recording resolution.

According to the present invention, the overlap-permissible diameter d2 of the mist dots is ascertained, the drive conditions and/or the recording resolution are set in such a manner that the relationship between this overlap-permissible diameter d2 and the pitch between dot centers Pt defined by the recording resolution satisfies $Pt \geqq d2$, and the driving of the mist generation device (i.e., the ink deposition by spraying the ink mist) is controlled in accordance with this setting.

The driving of the mist generation device (vibration generation device) is controlled on the basis of the input image data, and a charged mist (mist of ink particles) is ejected from the ejection ports. The cluster of charged mist thus ejected is accelerated toward the recording medium by the electrostatic force of the electric field and is deposited on the recording medium. In this way, a dot is formed by the mist cluster deposited on the recording medium. By controlling the ejection timing and the ejection volume of the ink droplets in accordance with the image data, it is possible to record a desired image (dot arrangement) on the recording medium. According to the image forming apparatus of the present invention, it is possible to prevent the occurrence of deposition interference, and therefore it is possible to form images of high quality at high speed, without being subject to the restrictions of the dot fixing time.

The overlap-permissible diameter d2 of the mist dot is dependent on the mist density (the number of mist particles in one dot), and the higher the mist density, the greater the overlap-permissible diameter tends to be. Therefore, in the case of an apparatus (system) composition that allows the mist density to be varied in ejection, provided that the pitch between dot centers Pt is set by using the overlap-permissible diameter d2 for the mist dots ejected at the maximum mist density ejection conditions, in such a manner that the relationship $Pt \geqq d2$ is satisfied, then deposition interference does not occur even when the droplets are deposited substantially simultaneously at high speed, under ejection conditions of lower mist density than the maximum mist density.

In order to output an image of high resolution at high speed, it is desirable to use a mist ejection head in which a plurality of liquid droplet ejection elements (liquid chamber units each of which forms a recording element), each having an ejection port for ejecting liquid droplets, a liquid chamber corresponding to the ejection port, and a mist generation device, are arranged so as to achieve a high density of the ejection port pitch when projected to an alignment in the main scanning direction perpendicular to the conveyance direction of the recording medium.

A full-line type mist ejection head having nozzle rows in which a plurality of ejection ports (nozzles) are aligned over a length that corresponds to the entire width of the recording medium can be used as a structural embodiment of the mist ejection head.

In one embodiment of this case, a plurality of relatively short ejection head modules that have nozzle rows shorter than the entire width of the recording medium are combined, and these head modules are joined together to configure nozzle rows of a length that corresponds to the entire width of the recording medium.

A full-line type mist ejection head is normally disposed along a direction orthogonal to the relative feeding direction (relative conveyance direction) of the recording medium, but another possible embodiment is to dispose the mist ejection head along a direction slanted at a specific angle in relation to the direction orthogonal to the conveyance direction.

When color images are formed, a full-line type head may be disposed separately for each of a plurality of ink colors, or the configuration may be designed such that a plurality of ink colors can be ejected from one head.

The term "recording medium" refers to a medium onto which liquid ejected from the ejection ports is deposited, and the equivalent of the medium used in an image forming apparatus is recording paper or another such recording medium. Specifically, the "recording medium" can also be referred to as a printing medium, image formation medium, recorded medium, image receiving medium, or the like, and includes various media regardless of their material or shape, such as continuous paper, cut paper, sealing paper, OHP sheets and other such resin sheets, films, cloth, printed boards on which wiring patterns are formed, and intermediate transfer printing mediums.

The conveying device which moves the recording medium and the mist ejection head relatively to each other includes an embodiment wherein the recording medium is conveyed relatively to a stationary (fixed) head, an embodiment wherein the head is moved relatively to a stationary (fixed) recording medium, and an embodiment wherein both the head and the recording medium are moved.

Furthermore, the present invention is not limited to a full line head as described above, and it may also be applied to a method which records by scanning a recording head of a length shorter than the page width of the recording medium, a plurality of times, such as a shuttle scanning method.

Preferably, the image forming apparatus according to the present invention further comprises: a storage device which stores information on the overlap-permissible diameter d2 for each of a plurality of combinations of different types of recording media and inks; and an information acquisition device which acquires information identifying the combination of the type of recording medium and the ink that are used, wherein the information on the overlap-permissible diameter d2 corresponding to the combination identified to be used is read out from the storage device in accordance with the information acquired by the information acquisition device.

The overlap-permissible diameter d2 of the mist dots is also dependent on the combination of the recording medium and the ink used. In the case of a composition where a plurality of different types of recording medium and/or inks can be used selectively, a desirable mode is one in which information relating to the overlap-permissible diameter d2 is stored in a storage device, such as a memory, for each of the possible combinations to be used, and the combination of the recording medium and the ink actually being used is then identified and the corresponding information is read out and adopted.

By adopting this mode, it is possible to set print conditions which enable the formation of high-quality images at high speed, even if the type of recording medium and/or the ink changes.

The "information acquisition device" includes, for example, at least one of a device which identifies the type of recording medium (a recording medium type identification device) and a device which identifies the type of ink (ink type identification device). In a case where the type of both the recording medium and the ink can be changed, then a desirable mode is one in which both the recording medium type identification device and the ink type identification device are provided. If it is only possible to change the type of recording medium and the ink type does not change, then it is not necessary to provide the ink type identification device and only the recording medium identification device may be provided. On the other hand, if the recording medium type does not change and only the ink type can be changed, then it is not necessary to provide the recording medium type identification device and only the ink type identification device may be provided.

The recording medium type identification device may comprise, for example, a device which measures the reflectivity of the recording medium, or a device which reads in the type of the recording medium used from the ID, or the like, of the supply magazine. Furthermore, the recording medium type identification device is not limited to a device which obtains information automatically by means of sensors, an information reading device, or the like, and it may also be constituted in such a manner that information relating to the type of recording medium or the like is input by a user by means of a prescribed input apparatus (user interface), or the like.

The ink type identification device may comprise, for example, a device which measures the property (e.g., reflectivity or electric resistance) of the ink, or a device which reads in the type of the ink from the ID, or the like, of the ink tank. Furthermore, the ink type identification device is not limited to a device which obtains information automatically by means of sensors, an information reading device, or the like, and it may also be constituted in such a manner that information relating to the type of ink or the like is input by a user by means of a prescribed input apparatus (user interface), or the like.

Preferably, the setting device sets the drive conditions of the mist generation device in accordance with a specified recording resolution.

By prioritizing the recording resolution when setting the drive conditions for the mist generation device (in other words, the mist density conditions, or the like), it is possible to print an image of high resolution at high speed.

Alternatively, it is also desirable that the setting device sets the recording resolution in accordance with a number of bursts applied for a single dot which is previously established.

According to this aspect of the present invention, it is possible to print an image in which image quality in the high-density image region is prioritized, with good quality.

In order to attain the aforementioned object, the present invention is also directed to an image forming method for forming an image on a recording medium by generating a mist from a surface of ink inside an ejection port by applying vibration energy to ink filled in a liquid chamber, and depositing the mist onto the recording medium by using an electric field, the image forming method comprising the step of: setting at least one of drive conditions of a mist generation device required to apply the vibration energy and a recording resolution in such a manner that a relationship $Pt \geqq d2$ is satisfied, where d2 is an overlap-permissible diameter which is a minimum distance between centers of two mist dots formed by the mist on the recording medium that allows shapes of the two mist dots to be fixed as a prescribed shape when the two mist dots are deposited on the recording medium substantially simultaneously under substantially same ejection conditions so as to overlap partially with each other, and Pt is a pitch between the centers of the two mist dots defined by the recording resolution.

According to the present invention, by achieving droplet ejection conditions which allow deposition interference to be suppressed by introducing the concept of the overlap-permissible diameter d2 of the mist dots, then high-speed, high-quality printing becomes possible, without being subject to the restriction of the dot fixing time.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIGS. 7A to 7D are schematic diagrams showing states where two mist dots are ejected simultaneously under conditions where the two circles having a virtual diameter make contact with each other;

FIG. 8 is a table showing the results of the evaluation of dot shape preservation in the case of high-density mist dots;

FIG. 10 is a table showing the results of the evaluation of dot shape preservation in the case of medium-density mist dots;

FIGS. 11A to 11C are schematic drawings showing the amount of overlap between mist dots;

DESCRIPTION OF THE PREFERRED EMBODIMENTS

Structure of Ink Ejection Head

Figure 1:
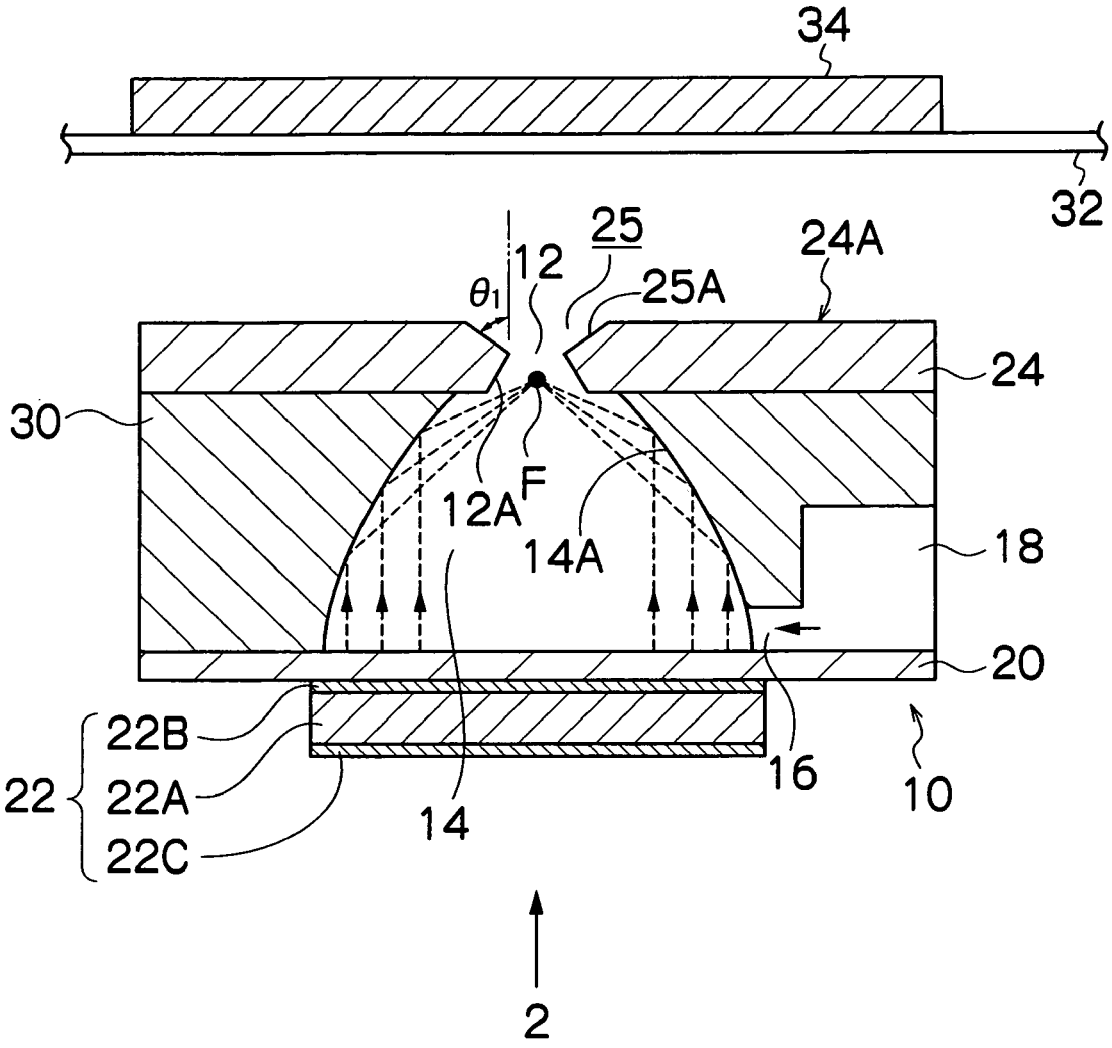
FIG. 1 is a cross-sectional diagram showing the basic composition of a mist spraying device applied for an image forming apparatus according to an embodiment of the present invention.

FIG. 1 is a cross-sectional view showing the basic configuration of a mist spraying device (ink ejection head) in an image forming apparatus according to an embodiment of the present invention. The mist spraying device 10 shown in FIG. 1 includes a nozzle 12 as an ejection port for ink mist, an ink chamber 14, an ink supply port 16, a common flow channel 18 which accommodates ink to be supplied to the ink chamber 14, an insulating resin film 20, and a piezoelectric element 22 serving as a mist generating device. FIG. 1 shows a cross-sectional view of an ink chamber unit corresponding to one nozzle 12 (the liquid droplet ejection element for one channel). When this ink chamber unit is applied to a print head (also referred to as a "recording head") or another such mist ejecting head, a plurality of channels are arrayed either one-dimensionally (in a row) or two-dimensionally (across a plane).

The nozzle plate 24 in which the nozzles 12 are formed is constituted by a conducting material, such as metal, and also serves as a charging electrode (the first electrode) for charging the ink liquid, and a convergence and acceleration electrode (the second electrode) that converges and accelerates the charged mist.

The nozzle 12 has a tapered shape wherein the cross-sectional area (inside diameter) gradually decreases from the side of the nozzle plate 24 adjacent to the ink chamber 14 (the bottom side in FIG. 1) in the direction of ink ejection (the upward direction in FIG. 1). A recess 25 with a flared shape, in which the cross-sectional area (inside diameter) gradually increases in the direction of ink ejection, is formed in the ink ejection side of the nozzle plate 24 (the top side in FIG. 1, which is the side reverse to the side adjacent to the ink chamber 14) along the outer periphery of the nozzle 12 (ejection port).

In the nozzle plate 24 in FIG. 1, the inner surface 12A of the nozzle 12 and the surrounding area, which are in contact with the ink, function as the charging electrode (the first electrode), and the uneven (unflat) electrode surface that is composed of the inner surface 25A of the flared recess 25 formed on the outside of the ejection opening of the nozzle 12 and a flat area 24A around the recess 25 functions as the convergence and acceleration electrode (the second electrode).

For the sake of convenience in the descriptions, the inner surface 25A of the recess 25 is hereinafter referred to as the "convergence electrode receding surface 25A".

The flaring angle $\theta_1$ of the convergence electrode receding surface 25A (which angle $\theta_1$ is the angle of the inclined surface on one side opening to the outside with respect to the direction of ink ejection, as shown in FIG. 1) is preferably 60 degrees or greater ($\theta_1 \geqq 60°$) so that the electric flux lines of the convergence and acceleration electric field are not drawn into the nozzle 12.

The flat area 24A (the horizontal area in FIG. 1) of the nozzle plate 24 around the convergence electrode receding surface 25A functions as the electrode that contributes toward creating the electric flux lines needed to form an electric field suitable for converging the mist by means of the difference in shape with the convergence electrode receding surface 25A. The flat area 24A is hereinafter referred to as the "convergence electrode external surface 24A". More specifically, in the present embodiment, the electrode surface that includes the convergence electrode receding surface 25A and the convergence electrode external surface 24A serves as the second electrode.

The inner circumferential face of the ink chamber 14 has a parabolic shape, and an ink chamber forming plate 30 and the nozzle plate 24 are bonded together in such a manner that the center of the opening on the ink chamber 14 side of the nozzle 12 is located at the focal point F of the parabolic surface 14A. The parabolic surface 14A forms a reflecting plate reflecting ultrasonic waves generated by the piezoelectric element 22, and therefore, in order to achieve high reflectivity, it is desirable to use a metal material for the ink chamber forming plate 30.

The resin film 20 is arranged on the side of the ink chamber forming plate 30 reverse to the nozzle plate 24, and is bonded to the ink chamber forming plate 30 in a composition which seals off one face of the ink chamber 14 (the bottom face in FIG. 1). Ink introduced from the common flow channel 18 through the ink supply port 16 is filled into the space (ink chamber 14) surrounded by the parabolic surface 14A, the resin film surface 20, and the nozzle plate 24.

Figure 2:
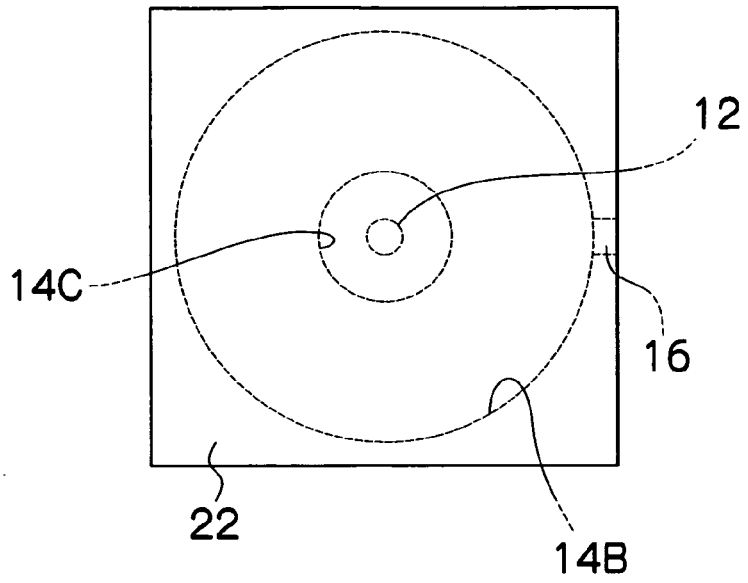
FIG. 2 is a plan diagram viewed in the direction of arrow 2 in FIG. 1.

The piezoelectric element 22 functions as a vibrating element and is bonded on the surface (the lower surface in FIG. 1) of the resin film 20 reverse to the surface thereof adjacent to the ink chamber 14. FIG. 2 shows a plan diagram of the piezoelectric element 22 (a view in the direction of the arrow 2 in FIG. 1). As shown in FIG. 2, the piezoelectric element 22 has a surface area which covers the upstream side opening 14B of the parabolic surface 14A. FIG. 2 shows an embodiment comprising a substantially square-shaped piezoelectric element 22 having a surface area larger than the upstream side opening 14B of the parabolic surface 14A, but the planar shape of the piezoelectric element 22 is not limited to being a square shape, and it may also be another quadrilateral shape, such as a rectangular or rhombic shape, or a hexagonal shape, octagonal shape, or other polygonal shape, or a circular or elliptical shape, or the like. In FIG. 2, the dashed circle denoted with the reference numeral 14C is the downstream side opening of the parabolic surface 14A (the edge of the opening which is in contact with the nozzle plate 24) (see FIG. 1).

As shown in FIG. 1, the piezoelectric element 22 has a structure in which electrodes 22B and 22C are formed on either surface of a piezoelectric body 22A. In the embodiment shown in FIG. 1, the electrode 22B on the side bonded to the resin film 20 is a common electrode, and the electrode 22C on the other side is an independent drive electrode (hereinafter referred to as the "individual electrode").

In this composition, by applying a high-frequency drive signal (drive voltage) to the individual electrode 22C of the piezoelectric element 22, the piezoelectric element 22 is made to vibrate and generate an ultrasonic wave. The resin film 20 vibrates in conjunction with the piezoelectric element 22, due to its flexibility, and hence the ultrasonic wave radiates into the ink through the resin film 20.

The ultrasonic wave radiating into the ink from the piezoelectric element 22 propagates through the ink chamber 14, through the medium of the ink, and converges in the vicinity of the focal point F (in the vicinity of the central region of the nozzle 12), due to reflection at the parabolic surface 14A. FIG. 1 shows a schematic diagram in which the directions of travel of the wave fronts of the pressure waves having the ultrasonic frequency are indicated by broken lines. Due to the energy of the concentrated ultrasonic wave, a capillary wave intrinsic to the frequency is generated in the free surface of the liquid (the liquid-atmosphere interface, which is also commonly called "meniscus") in the nozzle section 12, and fine droplets of the ink become separated from the wave peaks in the minute surface wave thus created. Consequently, a collection of fine particles of the ink in the form of a mist (a mist cluster) is sprayed from the nozzle 12.

A recording medium (recording medium) 32 such as recording paper is conveyed while maintaining a uniform distance from the ink ejecting surface (the flat face of the convergence electrode external surface 24A in FIG. 1) of the nozzle plate 24. A flat plate-shaped rear surface electrode 34 is disposed on the rear surface of the recording medium 32 (reverse to the recording surface on which ink particles are deposited), and the recording medium 32 is held (supported) by the rear surface electrode 34. By applying a direct current voltage between the nozzle plate 24 (the nozzle electrode) and the rear surface electrode 34, the ink liquid in the nozzle section is charged with a positive charge, and the electric field (acceleration electric field that has the effect of converging mist) is generated between the electrodes 24 and 34, and the charged mist sprayed from the nozzle 12 is accelerated by the resulting electrostatic force and is deposited onto the recording medium 32.

Figure 3:
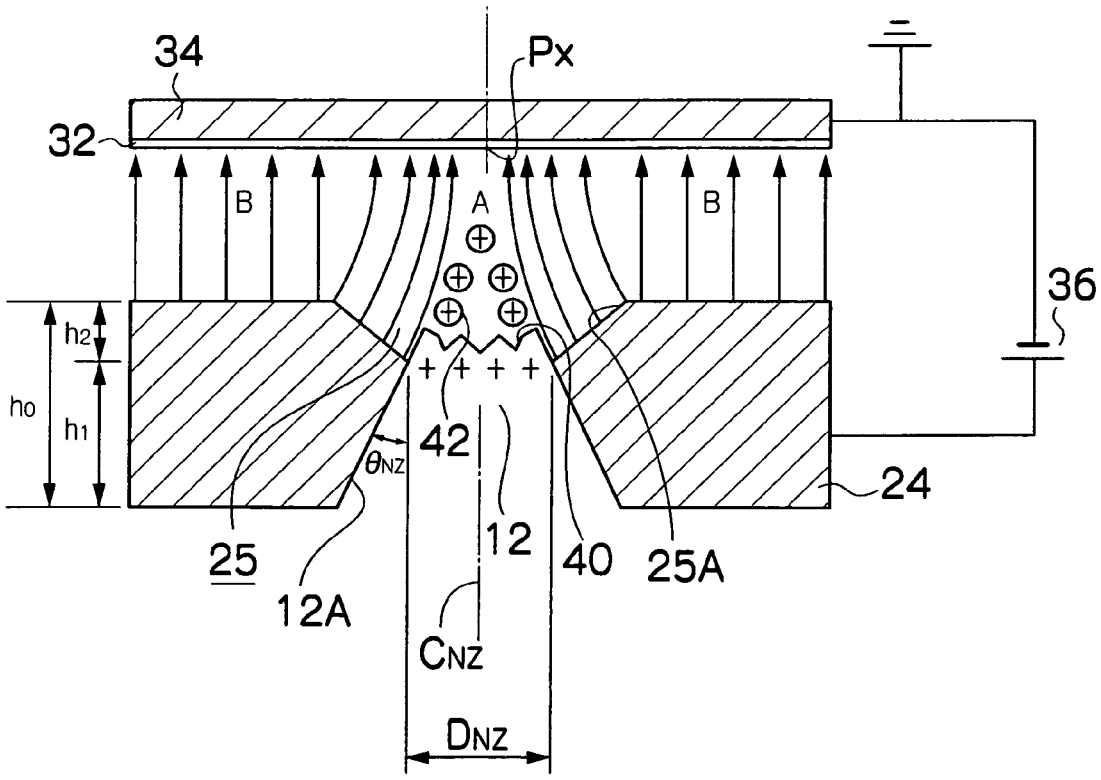
FIG. 3 is an enlarged diagram showing a schematic view of the nozzle section.

FIG. 3 is an enlarged diagram showing a schematic view of the nozzle section. The earthed rear surface electrode 34 is disposed in parallel with the nozzle plate 24, and functions as the opposing electrode for the nozzle electrode configured from the nozzle plate 24. As shown in FIG. 3, the positive pole of a charging and accelerating power source 36 is connected to the nozzle electrode (nozzle plate 24), and a specific direct current voltage is applied to the nozzle electrode (nozzle plate 24). Driving the piezoelectric element 22 (see FIG. 1) in this state of applied voltage causes an electric charge to be induced in the liquid surface 40 in the nozzle 12, and causes clusters (charged mist) of positively charged ink micro-particles 42 to be sprayed from the liquid surface 40, as shown in FIG. 3.

The electric field that converges and accelerates the clusters of charged ink micro-particles 42 toward the recording medium 32 is formed between the nozzle electrode (nozzle plate 24) and the rear surface electrode 34. The solid arrows drawn between the electrodes 24 and 34 provide a schematic representation of the electric flux lines.

The formation of the convergence electrode receding surface 25A in the flared shape around the opening of the nozzle 12 causes the space potential of the region indicated by A in FIG. 3 (the electric field region corresponding to the region of the opening of the nozzle 12) to be lower than the space potential of the region indicated by B in FIG. 3 (the electric field region corresponding to the region of the convergence electrode external surface 24A). This difference in space potential and the resulting nonuniform electric field cause the charged mist of ink micro-particles 42 to be converged toward the point Px, at which the center axis $C_{NZ}$ of the nozzle 12 intersects with the recording medium 32 (the point directly above the hole of the nozzle 12 in FIG. 3).

The dots recorded on the recording medium 32 can thereby be prevented from expanding in diameter, making high-precision image recording possible.

Specific numerical values related to the thickness $h_0$ of the nozzle plate 24, such as the nozzle length $h_1$, the depth $h_2$ of the recess 25, the taper angle $\theta_{NZ}$ of the inner surface 12A of the nozzle 12, and the nozzle diameter $D_{NZ}$ (the diameter of the narrowest part of the nozzle 12), are set to appropriate values according to their relationship to the distance from the rear surface electrode 34, the applied voltage, the recording resolution, and other such various set conditions.

If a power source having a controllable voltage output (for example, a multi-output power source) is used as the charging and accelerating power source 36, it is then possible to temporally separate the charging function (to apply the charging voltage) and the accelerating function (to apply the accelerating voltage) of the charging and accelerating power source 36, by temporally switching the voltages applied to the nozzle electrode (nozzle plate 24).

Mist Distribution In Deposited Dots

Figure 4:
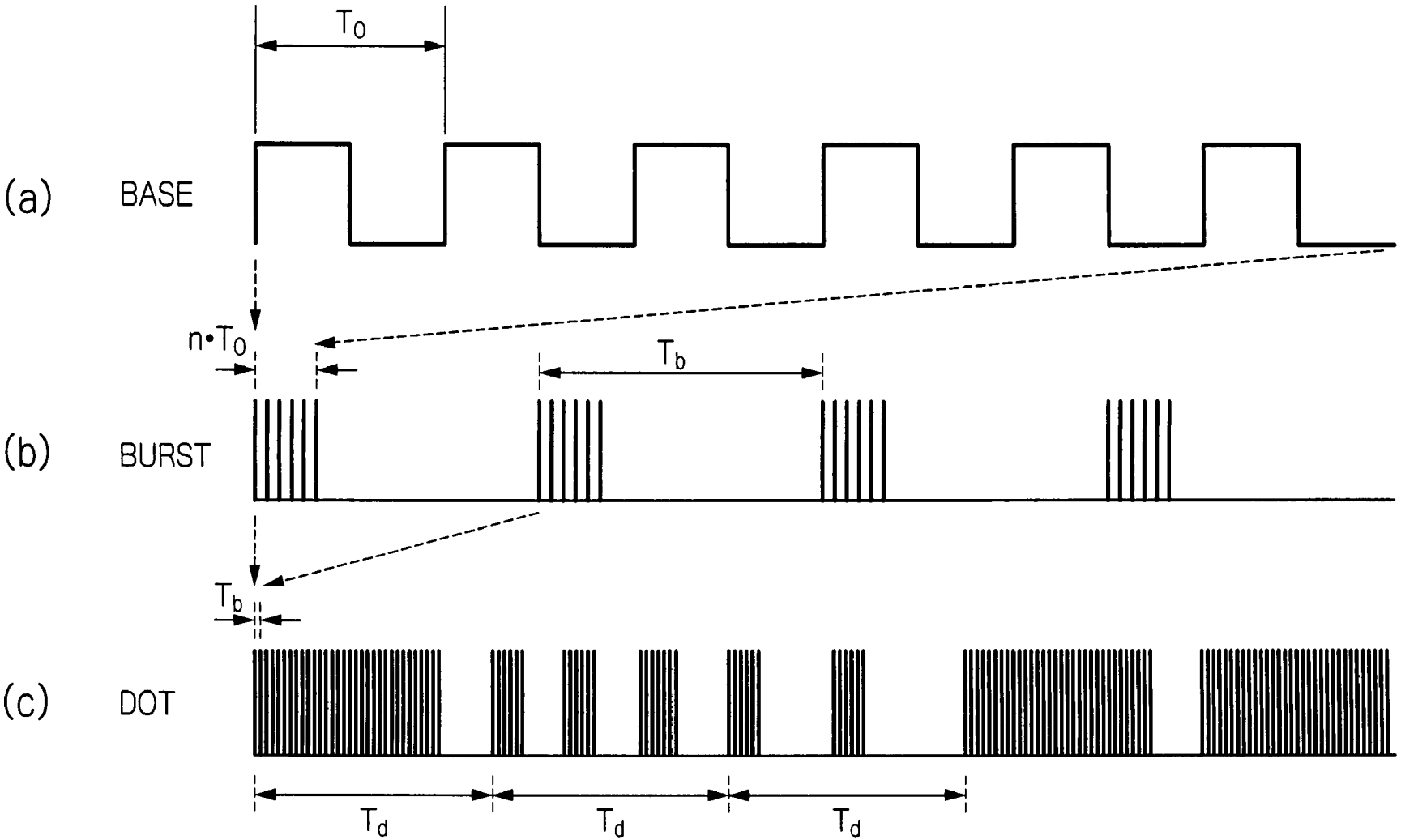
FIG. 4 is a diagram showing one embodiment of a head drive signal.

FIG. 4 is a diagram showing an embodiment of a head drive signal (reference source: Fukumoto et al., Journal of Imaging Science and Technology, Vol. 44, No. 5, September/October 2000, pp. 398-405). In FIG. 4, a portion (a) shows a basic signal having a high frequency, a portion (b) shows a burst signal applied to the piezoelectric elements, and a portion (c) shows a dot density control signal in order to control the dot density.

The frequency $f_0(=1/T_0)$ of the basic signal shown in the portion (a) in FIG. 4 is adjusted to the resonance frequency (base frequency) of the piezoelectric elements. In the present embodiment, the frequency $f_o$ is 10 MHz. The burst signal shown in the portion (b) in FIG. 4 has a cyclic output of n periods of the high frequency basic signal. The burst frequency $f_b(=1/T_b)$ is adjusted to the natural frequency of the vibration of the liquid surface in the nozzles, in order to suppress irregular vibration of the liquid surface.

The ink volume ejected in one burst (the duration of $n \cdot T_0$) of the burst signal is not sufficient to obtain a full (maximum) tonal density for one dot, and one dot is formed by superimposing ink mists sprayed by a plurality of bursts. More specifically, the term "one dot" in the present embodiment signifies a recording point (pixel) that has a substantially circular shape and is constituted by ink mists deposited on the recording medium in one ejection operation (i.e., bursts in a time period of $T_d$).

As shown in the portion (c) in FIG. 4, the time period $T_d$ for recording one dot is set to be equal to or greater than a time period that contains a number of bursts enough to ensure the ink volume required to attain the full tonal density. It is possible to control the density in each dot, by altering the number of bursts within the time period $T_d$ for recording one dot. In other words, the density of a dot is determined by the number of bursts applied for that dot.

Figure 5A:
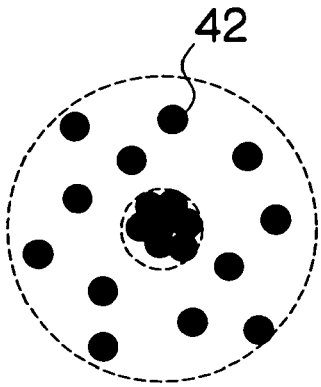
FIGS. 5A to 5C are conceptual diagrams of dots recorded by altering the number of applied bursts.
Figure 5B:
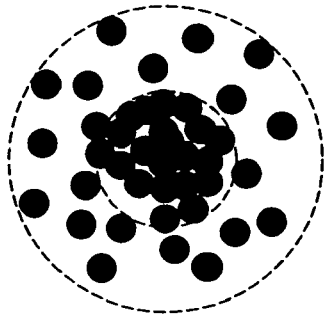
Figure 5C:
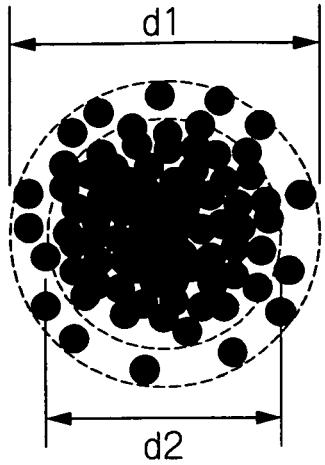

FIGS. 5A to 5C are conceptual diagrams of dots recorded with altering the number of bursts. FIG. 5A shows a case where the number of bursts is two, FIG. 5B shows a case where the number of bursts is four, and FIG. 5C shows a case where the number of bursts is six. As shown in FIGS. 5A to 5C, the dots are formed of a two-dimensional collection of ink micro-particles 42, and the number of mist particles (ink micro-particles 42) forming one dot is controlled by the number of bursts during the ejection period (one dot period $T_d$) corresponding to one dot.

The outermost diameter d1 of one dot and an effective diameter d2 (which corresponds to an overlap-permissible diameter described later) of the dot depend on the dimensions of the ejection head shown in FIG. 1, the physical values (principally, the viscosity and surface tension) of the liquid to be deposited, the energy applied to the piezoelectric element 22, and the like.

Consideration and Means for Prevention of Deposition Interference

The term "deposition interference" signifies a phenomenon in which two liquid droplets deposited adjacently on the surface of the recording medium overlap and combine with each other before fixing onto the recording medium, thereby disturbing the dot shapes or giving rise to mixing between inks of different colors, and thus making it impossible to obtain the desired image.

In the case of the ejection of very fine liquid droplets in which a plurality of mist particles are ejected to form one dot, it was demonstrated by experimental results on observation of the deposited liquid droplets that as the overall density of the mist particles increase, then the density in the central portion of the dot becomes higher, whereas the density in the peripheral portion of the dot becomes lower. Moreover, it was confirmed that as the overall density of the mist particles becomes higher, then there is a tendency for the ratio of the diameter of the high density region in the central portion of the dot to become larger with respect to the diameter of the whole dot (see FIGS. 5A to 5C).

For the sake of convenience, the dots shown in FIGS. 5A to 5C are hereinafter referred to as a "low-density mist dot", a "medium-density mist dot", and a "high-density mist dot", respectively.

Figure 6:
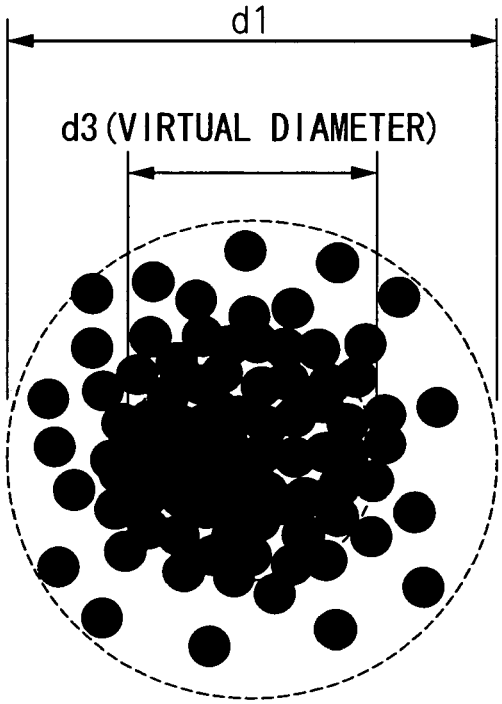
FIG. 6 is an enlarged diagram of a high-density mist dot (FIG. 5C)

FIG. 6 is an enlarged diagram of the high-density mist dot shown in FIG. 5C. A dot shape preservation evaluation experiment as described below was carried out with respect to the mist dot shown in FIG. 6.

At first, a "virtual periphery" having the diameter d3 (hereinafter also referred to as the "virtual diameter d3") was assumed inside the outermost periphery having the diameter d1 (hereinafter also referred to as the "outermost diameter d1") of the mist dot. The virtual diameter d3 was varied in steps, and then, at each step (i.e., at each virtual diameter d3), two mist dots were simultaneously deposited in the same ejection conditions, under mist dot overlap conditions whereby the two virtual peripheries having the diameter d3 were in contact with each other (i.e., under the conditions in which the distance between the centers of the two adjacent dots was d3).

The term "the same ejection conditions" signifies that the same number of bursts are applied for controlling the mist density (number of mist droplets) contained in the ejection for one dot.

FIGS. 7A to 7D are schematic diagrams showing situations in which the virtual diameters d3 of the mist dots differ in steps, and two mist dots are simultaneously deposited under conditions where the two virtual peripheries having the diameter d3 are in contact with each other, for each step (i.e., for each virtual diameter d3). In FIGS. 7A to 7D, the circles described with the dashed lines represent the outermost peripheries having the diameters d1, and the circles described with the solid lines therein represent the virtual peripheries having the diameters d3.

FIG. 8 is a table showing the results of the evaluation of dot shape preservation for the steps. From the experimental results shown in FIG. 8, it was confirmed that the dot shape preservation was satisfactory (there is no effect on image quality) at a virtual diameter ratio of d3/d1=0.6, and hence the virtual diameter d3 in this case is defined as the "overlap-permissible diameter d2".

The preservation of the dot shape is evaluated by assessing whether or not the dot shapes of the two mist dots can be fixed in a prescribed shape. Here, the term "prescribed shape" is described below from the viewpoint of deposition interference between the two mist dots of the same color.

Figure 9B:
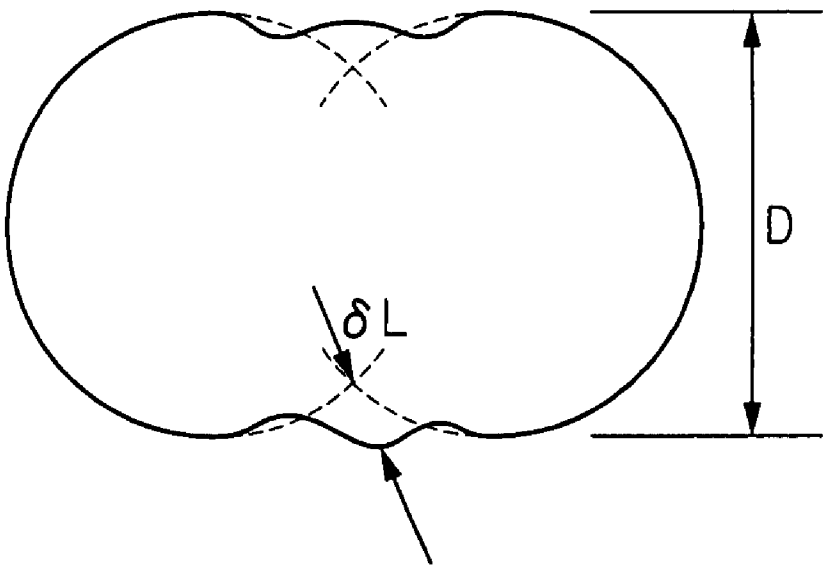
FIGS. 9A and 9B are diagrams showing the outline shape of dots used in order to describe the "prescribed shape" when evaluating the preservation of the dot shape.
Figure 9A:
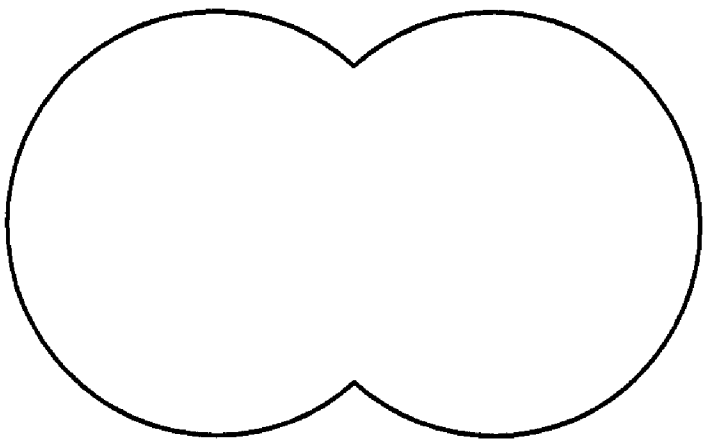

FIG. 9A is a diagram showing an outline shape of the two mist dots in a case where the two mist dots are deposited at a long time interval, and FIG. 9B is a diagram showing an outline shape of the two mist dots in a case where the two mist dots are deposited at a time interval that is equivalent to substantially simultaneous deposition.

If the second dot is deposited when the first dot has sufficiently fixed (i.e., at a long interval after the first dot has been deposited), the outline shape of the first and second dots becomes a combination of the two substantially circular arcs as shown in FIG. 9A. On the other hand, if the first and second dots are deposited substantially simultaneously, the dots shape is disturbed at the overlap section between the first and second dots as shown in FIG. 9B, and therefore the dots are deformed with respect to the ideal outline shape described with the dashed lines.

As shown in FIG. 9B, $\delta L$ is taken to be the greatest distance between the actual outline (the solid line) and the ideal outline (the dashed line) in the dot overlap section, and D is taken to be the diameter of one mist dot, then the "prescribed shape" is defined as a shape in which the ratio δL/D does not exceed 0.1.

Similarly to the experimental examples (i.e., the experimental examples regarding high-density mist dots) shown in FIG. 8, dot shape preservation was also evaluated for simultaneous deposition of medium-density mist dots, and FIG. 10 shows the results thereof.

In the experimental examples shown in FIG. 10, it was confirmed that the dot shape preservation was satisfactory (there is no effect on image quality) at the virtual diameter ratio of d3/d1=0.4, and hence the virtual diameter d3 in this case is defined as the "overlap-permissible diameter d2".

It was confirmed that, in general, the following relationship (1) is established between the overlap-permissible diameter $d2_H$ in the high-density mist dots, the overlap-permissible diameter $d2_M$ in the medium-density mist dots, and the overlap-permissible diameter $d2_L$ in the low-density mist dots:

$$d2_L < d2_M < d2_H \quad (1)$$

Hence, it is possible to ensure preservation of the dot shapes even when the mist dots are deposited in a substantially simultaneous fashion, by making sure of a condition where the two effective peripheries having the overlap-permissible diameter d2 are in contact with each other, then it is possible to prevent image deterioration due to deposition interference. Here, the "substantially simultaneous" deposition signifies that the interval between the deposition operations is approximately 100 μs or less.

From the relationship (1), the lower the density of the mist dots, the greater the amount of overlap between the mist dots that is permissible in the deposition operation.

FIGS. 11A to 11C are schematic diagrams showing the overlaps between the mist dots. FIG. 11A shows a case of low-density mist dots, FIG. 11B shows a case of medium-density mist dots, and FIG. 11C shows a case of high-density mist dots. In the case of the high-density mist dots (FIG. 11C), the overlap-permissible diameter $d2_H$ is large, and then the amount of overlap between the two outermost peripheries should be small. On the other hand, in the case of the low-density mist dots (FIG. 11A), the overlap-permissible diameter $d2_L$ is small, and then the amount of overlap between the two outermost peripheries can be large.

In the case of an inkjet system in the related art that deposits a single ink droplet for a dot (including cases where there are trailing satellite droplets), rather than using the mist system, marked deposition interference occurs. On the other hand, the experimental results revealed that in the case of mist ejection, since the deposition density of the mist is relatively small in the outer region between the diameters d2 and d1, then deposition interference of a level that affects image quality does not occur.

Consequently, it is derived from the experimental results that if mutually adjacent dots are continuously deposited in such a manner that the inner regions having the diameter d2 of the dots overlap each other, then the deposition interference occurs unless the later dot is deposited after the inner region having the diameter d2 of the former dot has completely fixed, and on the other hand, if mutually adjacent dots are deposited in such a manner that the inner regions having the diameter d2 of the dots do not overlap each other, then image deterioration due to deposition interference can be reduced to a very low level, even if the dots are deposited at high speed.

Figure 12A:
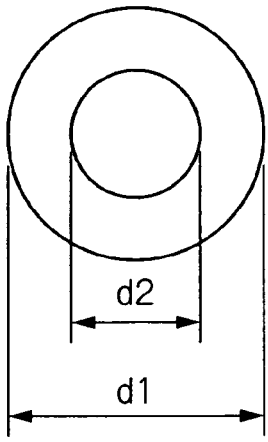
FIGS. 12A and 12B are illustrative diagrams showing a dot arrangement achieved by continuous deposition of mist dots.
Figure 12B:
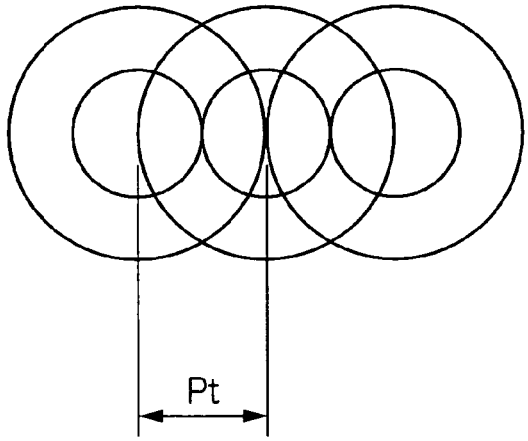

When continuously depositing mist dots having the outermost diameter d1 and the overlap-permissible diameter d2 as shown in FIG. 12A, if the distance between the mutually adjacent dots (the pitch between the centers of the dots) is taken to be Pt as shown in FIG. 12B, then by setting deposition conditions in such a manner that the relationship Pt≧d2 is satisfied (i.e., in such a manner that the inner regions having the overlap-permissible diameter d2 do not mutually overlap between the adjacent dots), it is possible to prevent deposition interference of a kind that causes deterioration of image quality, even when printing at high speed (depositing the dots in a substantially simultaneous fashion), without being restricted by the fixing time of the dots.

There are the following two setting modes for satisfying the relationship Pt≧d2.

In the first setting mode, the recording resolution (pitch between dot centers) takes precedence. For example, if the resolution is set to 2400 dpi (dots per inch) in the printer specifications, then Pt=10.6 μm, and the number of bursts applied per dot is controlled to satisfy the condition d2≦10.6 μm.

In the second setting mode, the maximum density per dot takes precedence. For example, if it is necessary to set d1=25 μm and d2=21.2 μm in order to guarantee the maximum density per dot, then Pt≧21.2 μm, and the output resolution is set to 1200 dpi.

Figure 13:
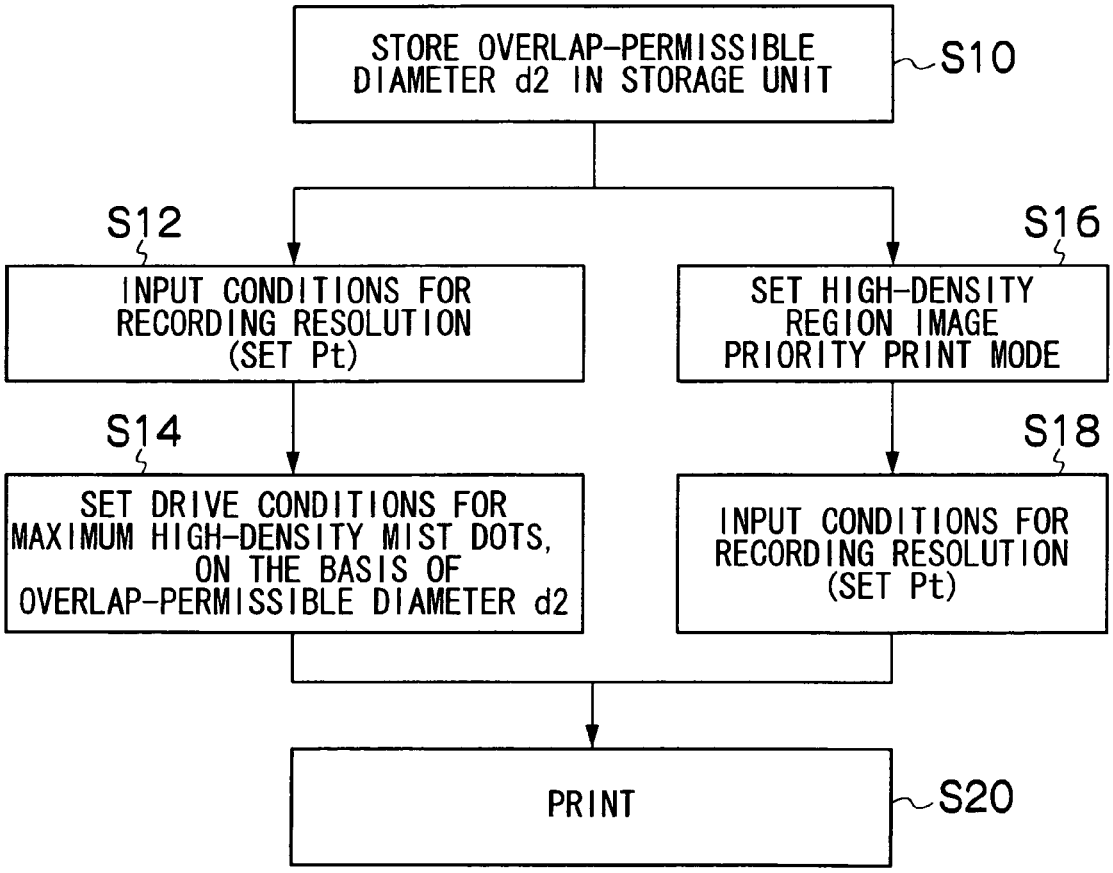
FIG. 13 is a flowchart showing an embodiment of a control procedure.

FIG. 13 is a flowchart showing steps of a control system.

Firstly, the overlap-permissible diameters d2 are determined in advance by experiment, for ejection conditions of high-density, medium-density and low-density mist dots, and this information is stored in a storage unit, such as a memory (step S10). In this case, the aforementioned overlap-permissible diameters d2 are determined for each of a plurality of different combinations of inks and types of recording medium, and a plurality of sets of the d2 data corresponding to this plurality of combinations are stored.

Thereupon, the processing branches according to whether the mode selected is a mode which prioritizes the recording resolution or a mode which prioritizes the maximum density for one dot. If the recording resolution is to be prioritized, then the procedure advances to step S12, where input of the recording resolution conditions is received. Setting of the recording resolution is equivalent to setting of the pitch between dot centers Pt described above. There are no particular restrictions on the device for inputting the recording resolution conditions, and there is, for example, a mode where a setting for the output recording resolution is input by an operator via an operating screen. For instance, three different resolutions are prepared, namely, high-resolution of 2400 dpi, medium-resolution of 1200 dpi and low-resolution of 600 dpi, in such a manner that the operator can select (specify) any one of these output recording resolutions. Alternatively, it is also possible to adopt a composition in which a number (dpi value) of a prescribed output recording resolution is input.

After inputting the recording resolution conditions at step S12, the procedure advances to step S14, where the data for the overlap-permissible diameter d2 is referenced and the driving conditions for the maximum high-density mist dots are set. Printing is subsequently carried out in accordance with these settings (step S20).

On the other hand, if the maximum density per dot is prioritized, then the procedure advances to step S16 from step S10, and a high-density region image priority print mode is set. There is no particular restriction on the device used to set this mode, and it is possible that the high-density region image priority print mode is set by an operator via an operating screen. When the operator has made a selection for the high-density region image priority print mode, then the overlap-permissible diameter d2 in the case of the ejection drive conditions for the maximum high-density mist dots is calculated accordingly. From the results of this calculation, the pitch between dot centers Pt is determined and the conditions of the output recording resolution are decided (step S18). Printing is subsequently carried out in accordance with these settings (step S20).

Structural Embodiment of Image Forming Apparatus

Next, an embodiment of an image forming apparatus, which adopts the mist spraying device described above as a print head, is described.

Figure 14:
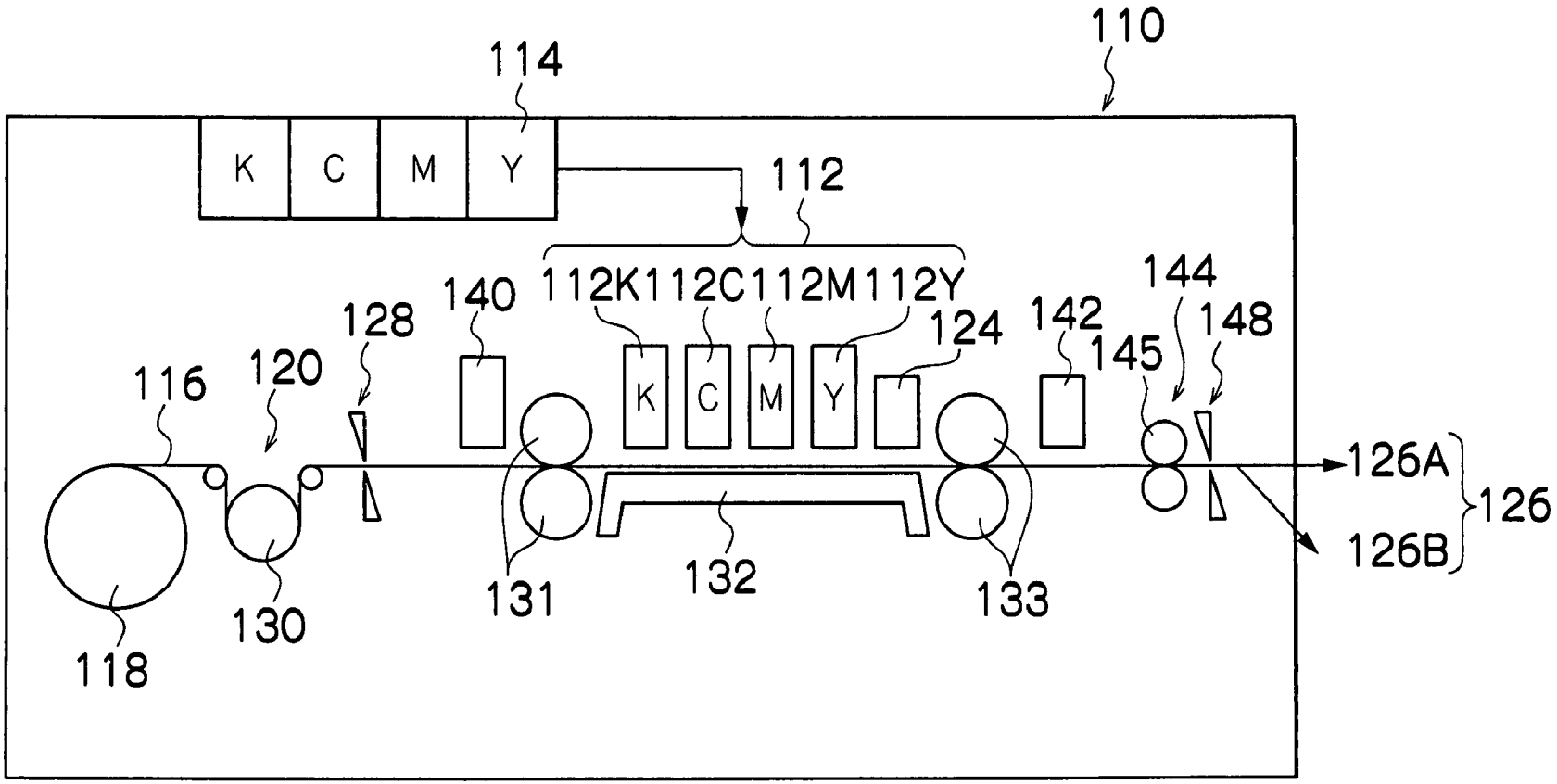
FIG. 14 is a general schematic drawing of an inkjet recording apparatus showing one embodiment of an image forming apparatus according to the present invention.

FIG. 14 is a general configuration diagram of an inkjet recording apparatus according to an embodiment of an image forming apparatus of the present invention. As shown in FIG. 14, the inkjet recording apparatus 110 comprises: a printing unit 112 having a plurality of mist ejection heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the heads 112K, 112C, 112M, and 112Y; a paper supply unit 118 for supplying recording paper 116 which is a recording medium; a decurling unit 120 removing curl in the recording paper 116; a platen 132 disposed facing the nozzle face (ink-droplet ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 14, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 14, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto the platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode 34 described with reference to FIG. 1 and the like. The platen 132 in FIG. 14 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is disposed on the upstream side of the printing unit 112 in the conveyance pathway of the recording paper 116. The heating fan 140 blows heated air onto the recording paper 116 to heat the recording paper 116 immediately before printing so that the ink deposited on the recording paper 116 dries more easily.

Figure 15:
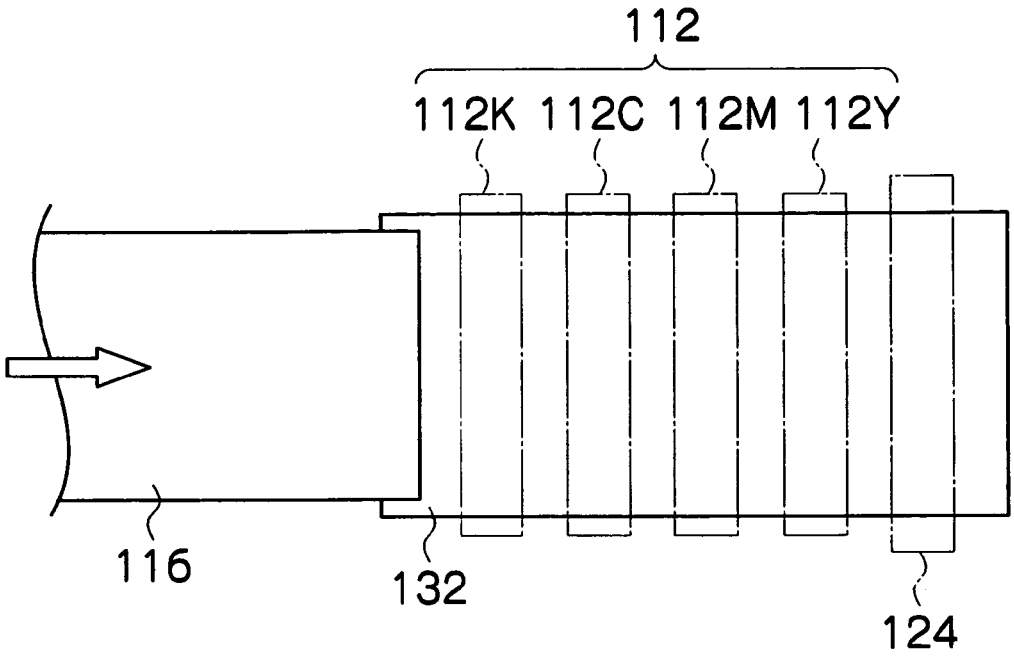
FIG. 15 is a principal plan diagram of the peripheral area of a print unit in the inkjet recording apparatus illustrated in FIG. 14.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on the nozzle face through a length exceeding at least one edge of the maximum-size recording paper (namely, the full width of the printable range) (see FIG. 15).

The heads 112K, 112C, 112M and 112Y are arranged in color order of black (K), cyan (C), magenta (M), yellow (Y) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the conveyance rollers 131 and 133.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for ejecting light-colored inks such as light cyan and light magenta are added. Furthermore, there are no particular restrictions of the sequence in which the heads of respective colors are arranged.

The print determination unit 124 illustrated in FIG. 14 has an image sensor (line sensor or area sensor) for capturing an image of the droplet ejection result of the print unit 112, and functions as a device to check for ejection defects such as blockages, depositing position displacement, and the like, of the nozzles from the image of deposited droplets read in by the image sensor. A test pattern or the target image printed by the heads 112K, 112C, 112M, and 112Y of the respective colors is read in by the print determination unit 124, and the ejection performed by each head is determined. The ejection determination includes the presence of the ejection, measurement of the dot size, and measurement of the dot depositing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming in contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 14, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 16:
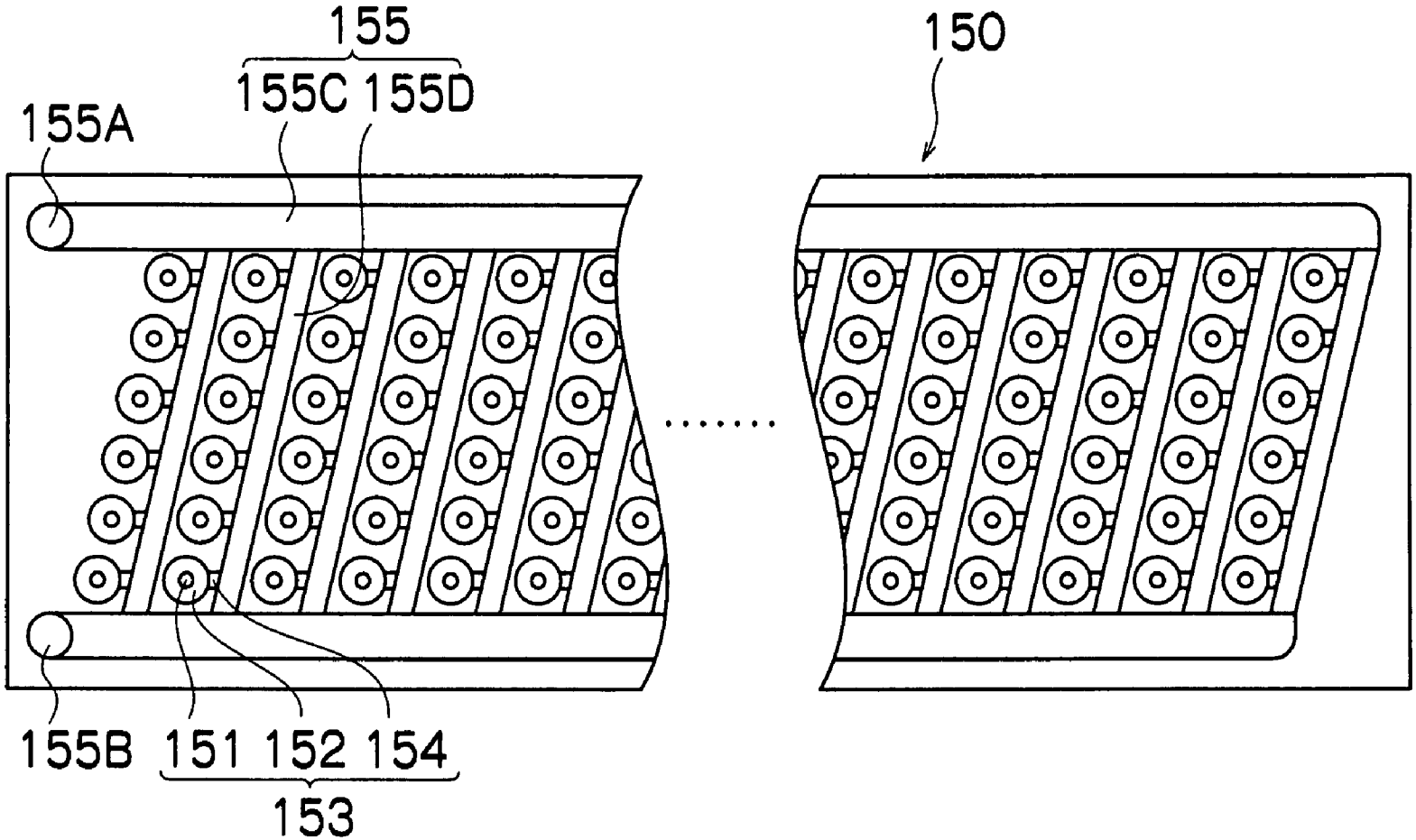
FIG. 16 is a plan view perspective diagram showing the internal structure of a print head.

FIG. 16 is a plan view perspective diagram showing the internal structure of the head 150. In order to achieve a high resolution (small pitch) of the dots printed onto the surface of the recording paper 116, it is necessary to achieve a high density (small pitch) of the nozzles in the head 150. As shown in FIG. 16, the head 150 according to the present embodiment has a structure in which a plurality of ink chamber units (liquid droplet ejection elements) 153, each having a nozzle 151 forming an ink ejection port, an ink chamber 152 corresponding to the nozzle 151, and the like, are disposed (two-dimensionally) in the form of a staggered matrix, and hence the effective nozzle interval (the projected nozzle pitch) as projected in the lengthwise direction of the head (the direction perpendicular to the paper conveyance direction) is reduced (high nozzle density is achieved). In FIG. 16, in order to simplify the drawing, the number of channels (number of ink chamber units 153) is omitted from the drawing.

The ink chambers 152 of the respective channels are connected to a common flow channel 155 through individual supply paths 154. The common flow channel 155 is connected to an ink tank which forms an ink source (not shown in FIG. 16 and equivalent to the ink storing and loading unit 114 shown in FIG. 14), through connection ports 155A and 155B, and the ink supplied from the ink tank is distributed and supplied to the ink chambers 152 of the respective channels through the common flow channel 155 in FIG. 16. The common flow channel 155 is composed of a main channel 155C and a distributary channel 155D, which branches off from the main channel 155C.

To give a brief description of the correspondence of the head 150 shown in FIG. 16 to the composition shown in FIG. 1, the nozzles 151, the ink chambers 152 and the individual supply paths 154 in FIG. 16 correspond respectively to the nozzles 12, the ink chambers 14 and the ink supply ports 16 shown in FIG. 1. Furthermore, the distributary channels 155D of the common flow channel 155 in FIG. 16 correspond to the common flow channel 18 shown in FIG. 1.

The detailed structure of each ink chamber unit 153 in FIG. 16 is similar to that described with reference to FIG. 1. FIGS. 1 and 2 show a structure in which the piezoelectric body 22A and the individual electrode 22C constituting the piezoelectric element 22 are separated into independent element units, but it is also possible to adopt a structure in which a piezoelectric body layer is formed integrally (as a single plate), without being separated into element units, and the individual electrodes are separated (by patterning into element units), in such a manner that a plurality of piezoelectric elements are formed which respectively use the regions of the piezoelectric body in the areas of their individual electrodes as active sections.

Figure 17:
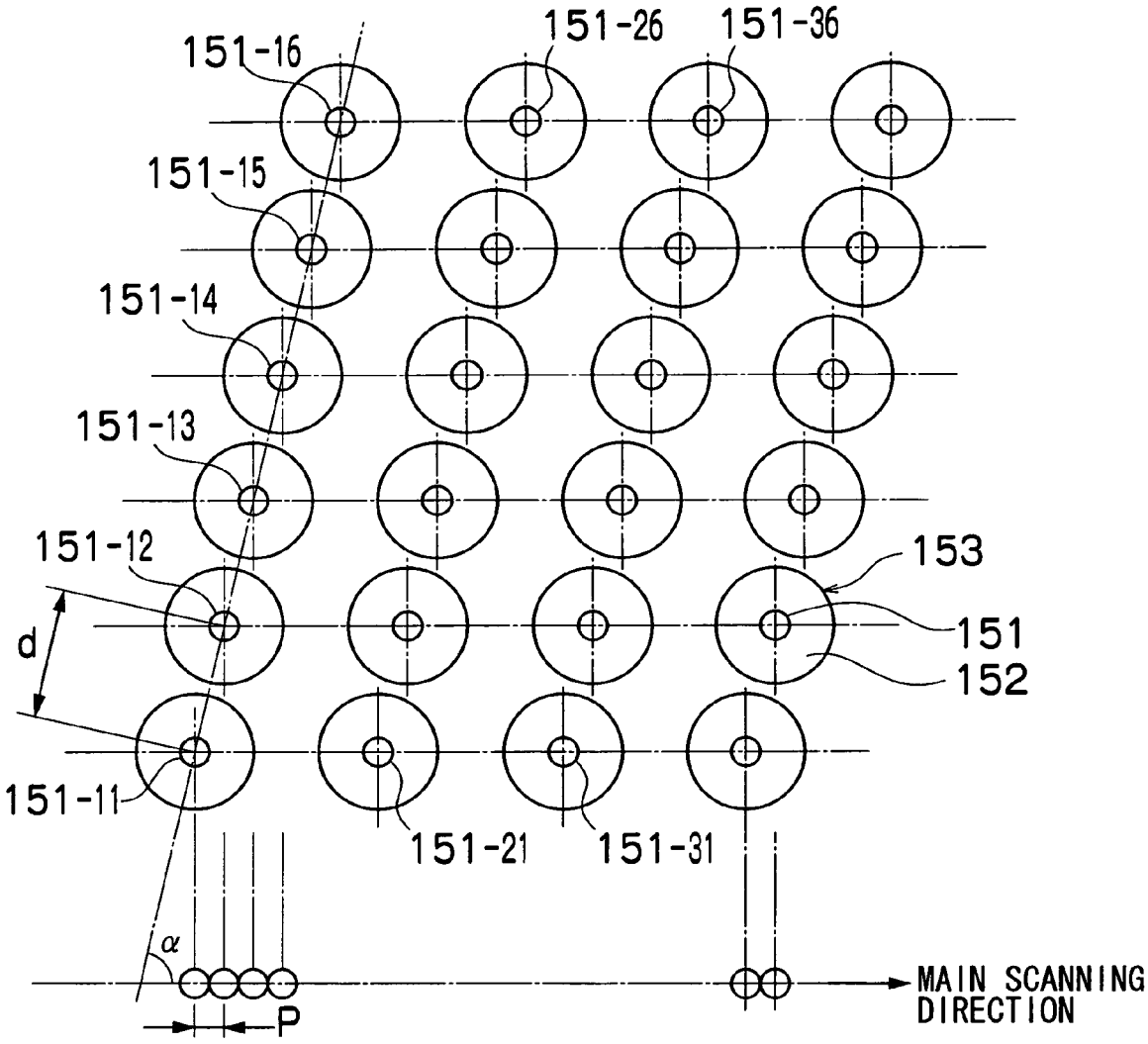
FIG. 17 is an enlarged diagram of the structural arrangement of ink chamber units in the head shown in FIG. 16.

FIG. 17 is an enlarged diagram of the structural arrangement of the ink chamber units 153 in the head 150 shown in FIG. 16. As shown in FIG. 17, the high-density nozzle head according to the present embodiment is achieved by arranging a plurality of ink chamber units 153 in a lattice fashion based on a fixed arrangement pattern, in a row direction which coincides with the main scanning direction, and a column direction which is inclined at a fixed angle of $\alpha$ with respect to the main scanning direction, rather than being perpendicular to the main scanning direction.

More specifically, by adopting a structure in which a plurality of ink chamber units 153 are arranged at a uniform pitch d in line with a direction forming the angle of $\alpha$ with respect to the main scanning direction, the pitch P of the nozzles projected so as to align in the main scanning direction is $d \times \cos \alpha$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 17 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-1, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper 116 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

Figure 18:
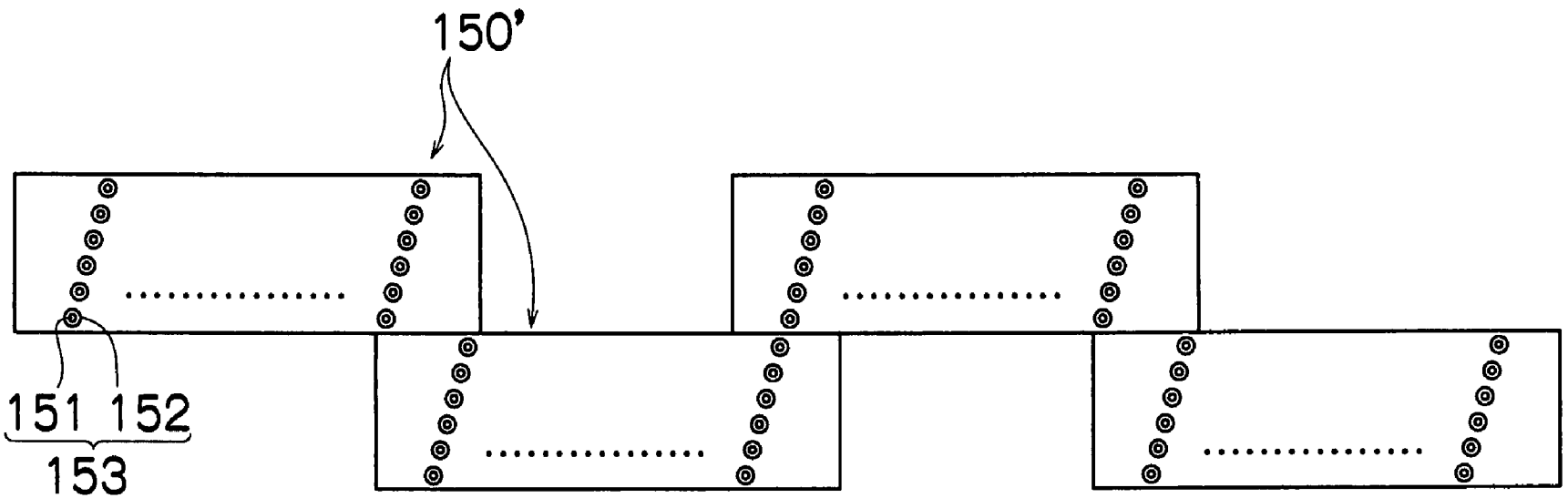
FIG. 18 is a plan view perspective diagram showing a further embodiment of the composition of a full line head.

In implementing the present invention, the nozzle arrangement structure is not limited to the embodiment shown in FIGS. 16 and 17. For example, in one mode of a full line head which has a nozzle row extending through a length corresponding to the full width of the recording paper 116 in a direction substantially perpendicular to the conveyance direction of the recording paper 116, instead of the composition shown in FIG. 16, it is possible to compose a line head having a nozzle row of a length corresponding to the full width of the recording paper 116 by joining together, in a staggered matrix arrangement, a plurality of short head blocks 150', each comprising a plurality of nozzles 151 arranged in a two-dimensional configuration, as shown in FIG. 18.

Description of Control System

Figure 19:
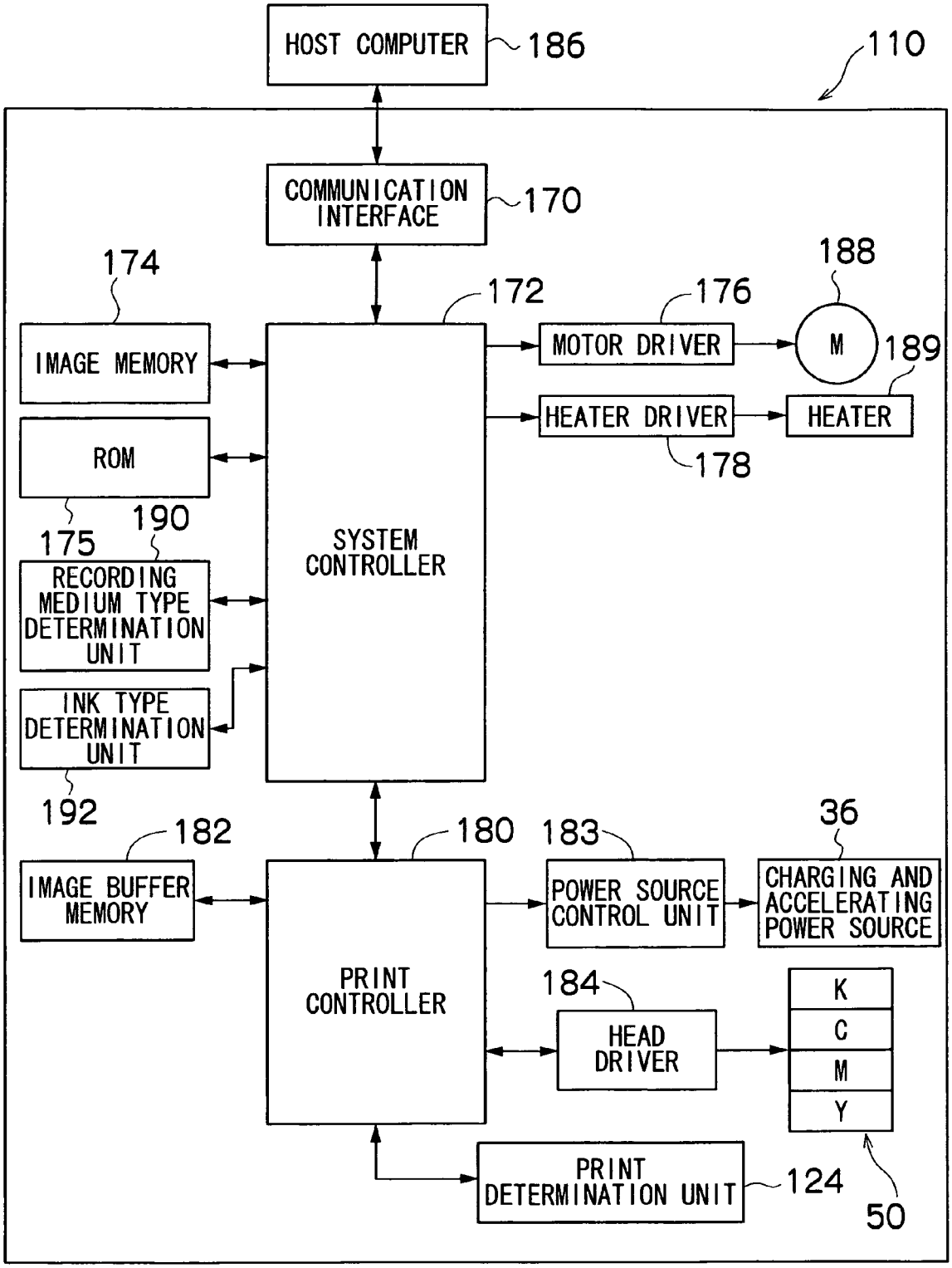
FIG. 19 is a principal block diagram showing the system composition of an inkjet recording apparatus according to the present embodiment.

FIG. 19 is a block diagram showing the system configuration embodiment of the inkjet recording apparatus 110. As shown in FIG. 19, the inkjet recording apparatus 110 comprises a communication interface 170, a system controller 172, an image memory 174, a ROM 175, a motor driver 176, a heater driver 178, a print controller 180, an image buffer memory 182, a power source control unit 183, a head driver 184, and the like.

The communication interface 170 is an interface unit (image input device) for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 14, for example. Furthermore, the heater 189 in FIG. 19 is a heating device which is used in the heating drum 130, heating fan 140 or post drying unit 142, as shown in FIG. 14.

The program executed by the CPU of the system controller 172 and the various types of data (including data on the overlap-permissible diameters d2) which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink droplet ejection, from the image data in the image memory 174, and it supplies the print data (dot data) thus generated to the head driver 184.

The print controller 180 is provided with the image buffer memory 182, and image data, parameters, and other data are temporarily stored in the image buffer memory 182 when the image is processed in the print controller 180. FIG. 19 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

The power source control unit 183 is constituted by a control circuit which controls the on/off switching and the output voltage of the charging and accelerating power source 36. The power source control unit 183 controls the output of the charging and accelerating power source 36 in accordance with commands from the print controller 180.

To give a general description of the sequence of processing from image input to print output, image data to be printed (original image data) is input from an external source through the communication interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. In this way, the dot data generated by the print controller 180 is stored in the image buffer memory 182.

The head driver 184 outputs drive signals for driving the piezoelectric elements 22 corresponding to the respective nozzles 151 of the head 150, on the basis of the ink dot data supplied by the print controller 180 (in other words, the ink dot data stored in the image buffer memory 182). In other words, the combination of the print controller 180 and the head driver 184 functions as a device corresponding to the "drive control device" of the present invention. A feedback control system for maintaining uniform driving conditions in the head may also be incorporated into the head driver 184.

The prescribed voltage is applied from the charging and accelerating power source 36 to the nozzle electrode of the head 150 (the nozzle plate 24 shown in FIG. 1), and the drive signals outputted from the head driver 184 are applied to the head 150, whereby an ink mist is ejected from the corresponding nozzles 151. By controlling ink ejection from the head 150 in synchronization with the conveyance speed of the recording paper 116, an image is formed on the recording paper 116.

As described above, the ejection volume and the ejection timing of the liquid droplets from the head 150 are controlled, on the basis of the dot data generated by implementing prescribed signal processing in the print controller 180. By this means, prescribed dot size and dot positions can be achieved.

The print determination unit 124 is a block that includes the image sensor as described above with reference to FIG. 14, reads the image printed on the recording paper 116, determines the print conditions (presence of the ejection, variation in the dot formation, optical density, and the like) by performing desired signal processing, or the like, and provides the determination results of the print conditions to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each ink chamber 152 of the head 150, and ejection abnormalities are determined from the determination signals obtained from these pressure sensors when ink is ejected or when the piezoelectric elements are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections (correction of the ejection volume, correction of the ejection position, and the like), with respect to the head 150, on the basis of the information obtained from the print determination unit 124 or another ejection determination device (not illustrated), according to requirements, and it implements control for carrying out cleaning operations (nozzle restoring operations), such as preliminary ejection, (which may also be called "purging", "dummy ejection", "blank ejection", or the like), nozzle suctioning, or wiping, as and when necessary.

The inkjet recording apparatus 110 is further provided with a recording medium type determination unit 190 and an ink type determination unit 192. The recording medium type determination unit 190 acquires information relating to the type of the recording medium in use, the ink type determination unit 192 acquires information relating to the type of the ink in use, and the information acquired through these devices is sent to the system controller 172.

The recording medium type determination unit 190 determines the type (e.g., paper type), size, and the like, of the recording medium. For example, the recording medium type determination unit 190 includes: an information reading device for reading in the type of the recording medium from an information recording body, such as a barcode, that records medium type information and is attached to the magazine in the paper supply unit 118 described with reference to FIG. 14; a sensor arranged at a suitable position in the conveyance pathway of the recording medium (e.g., a sensor which determines the width, thickness, optical reflectivity, or the like, of the recording medium); or a suitable combination of these. Furthermore, it is also possible to adopt a composition in which the information relating to the paper type, size, or the like, is specified by means of an input made through a prescribed user interface, instead of or in conjunction with such automatic determination devices.

For the device for acquiring information on the ink type in the ink type determination unit 192, it is possible to use, for example, a device which reads in ink properties information from the shape of the cartridge in the ink tank (a specific shape which allows the ink type to be identified), or from a bar code or IC chip incorporated into the cartridge. Besides this, it is also possible for an operator to input the required information through a user interface.

The system controller 172 and the print controller 180 identify the combination of the recording medium and the type of ink, on the basis of the information obtained by the media type information acquisition unit 190 and the ink type information acquisition unit 192, and they read out information on the overlap-permissible diameter d2 corresponding to that particular combination from the ROM 175, and use the information in order to control ejection in accordance with the combination of the recording medium and the ink.

In other words, in the present embodiment, the system controller 172, or a combination of the system controller 172 and the print controller 180 functions as a "setting device" which sets the driving conditions of the head 150 (in other words, the driving conditions of the piezoelectric elements corresponding to the respective nozzles), and the recording resolution, as well as an ejection control device (a deposition control device) which controls ejection in accordance with the setting.

According to the inkjet recording apparatus 110 having the composition described above, by achieving droplet ejection conditions under which deposition interference can be suppressed by using the concept of the overlap-permissible diameter of mist dots, then it is possible to print with high quality at high speed, without being restricted by the fixing time of the dots.

The embodiments described above relate to a page-wide line head, but the application of the present invention is not limited to a printer based on a line head, and it may also be applied to a printer which performs multi-pass scanning based on a shuttle scanning method, or overlap scanning using a short head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid chamber into which ink is filled;

an ejection port through which the ink is ejected from the liquid chamber;

a mist generation device which generates a mist from a surface of the ink inside the ejection port by applying vibration energy to the ink in the liquid chamber;

an electric field generation device which generates an electric field causing the mist ejected from the ejection port to move to a recording medium; and a setting device which sets at least one of drive conditions of the mist generation device and a recording resolution in such a manner that a relationship $Pt \geqq d2$ is satisfied, where d2 is an overlap-permissible diameter which is a minimum distance between centers of two mist dots formed by the mist on the recording medium that allows shapes of the two mist dots to be fixed as a prescribed shape when the two mist dots are deposited on the recording medium substantially simultaneously under substantially same ejection conditions so as to overlap partially with each other, and Pt is a pitch between the centers of the two mist dots defined by the recording resolution.

2. The image forming apparatus as defined in claim 1, further comprising:

a storage device which stores information on the overlap-permissible diameter d2 for each of a plurality of combinations of different types of recording media and inks; and an information acquisition device which acquires information identifying the combination of the type of recording medium and the ink that are used, wherein the information on the overlap-permissible diameter d2 corresponding to the combination identified to be used is read out from the storage device in accordance with the information acquired by the information acquisition device.

3. The image forming apparatus as defined in claim 1, wherein the setting device sets the drive conditions of the mist generation device in accordance with a specified recording resolution.

4. The image forming apparatus as defined in claim 1, wherein the setting device sets the recording resolution in accordance with a number of bursts applied for a single dot which is previously established.

5. An image forming method for forming an image on a recording medium by generating a mist from a surface of ink inside an ejection port by applying vibration energy to ink filled in a liquid chamber, and depositing the mist onto the recording medium by using an electric field, the image forming method comprising the step of:

setting at least one of drive conditions of a mist generation device required to apply the vibration energy and a recording resolution in such a manner that a relationship $Pt \geqq d2$ is satisfied, where d2 is an overlap-permissible diameter which is a minimum distance between centers of two mist dots formed by the mist on the recording medium that allows shapes of the two mist dots to be fixed as a prescribed shape when the two mist dots are deposited on the recording medium substantially simultaneously under substantially same ejection conditions so as to overlap partially with each other, and Pt is a pitch between the centers of the two mist dots defined by the recording resolution.

* * * * *